United States Patent [19]

Barber, Jr.

[11] Patent Number: 4,601,847

[45] Date of Patent: Jul. 22, 1986

[54] COMPOSITION FOR USE IN ELECTROPLATING OF METALS

[75] Inventor: Loren L. Barber, Jr., Lake Elmo, Minn.

[73] Assignee: MacDermid, Incorporated, Waterbury, Conn.

[21] Appl. No.: 662,776

[22] Filed: Oct. 19, 1984

Related U.S. Application Data

[62] Division of Ser. No. 525,578, Aug. 22, 1983, Pat. No. 4,502,926.

[51] Int. Cl.[4] ..... B01J 13/00

[52] U.S. Cl. ..... 252/312; 204/45.1; 204/55 R; 204/DIG. 2

[58] Field of Search ..... 204/45.1, 55 R, DIG. 2, 204/8.55 D, 312; 252/8.55 D, 312

[56] References Cited

U.S. PATENT DOCUMENTS

| | | | |
|---|---|---|---|
| 3,346,494 | 10/1967 | Robbins et al. | 252/312 X |
| 3,453,186 | 7/1969 | Hause et al. | 204/45.1 X |
| 3,954,967 | 5/1976 | Urton | 424/331 X |
| 3,964,548 | 6/1976 | Schroeder, Jr. et al. | 252/8.55 D X |
| 4,277,351 | 7/1981 | Powers, Jr. et al. | 252/8.55 D |

FOREIGN PATENT DOCUMENTS

| | | | |
|---|---|---|---|
| 2078281 | 1/1982 | United Kingdom | 252/8.55 D |

*Primary Examiner*—Richard D. Lovering

*Attorney, Agent, or Firm*—St. Onge Steward Johnston & Reens

[57] ABSTRACT

Disclosed herein are novel compositions for use as additives to electroplating baths, comprising a stable microemulsion formed from a functional chemical electroplating agent, which preferably is a brightening agent, water and a surfactant component, the concentration of functional agent in the microemulsion being at least about 1% by weight, based on the total weight of components of the microemulsion.

21 Claims, No Drawings

COMPOSITION FOR USE IN ELECTROPLATING OF METALS

This is a divisional of application Ser. No. 525,578, filed Aug. 22, 1983, now U.S. Pat. No. 4,502,926.

BACKGROUND OF THE INVENTION

The present invention relates to the electroplating of metals and, more particularly, to a brightening agent composition for addition to electroplating baths.

The electroplating of substrates such as steel, diecastings, copper and others is a widely accepted method for imparting to the substrates both decorative and functional features. In the decorative aspect, the aim is to provide a lustrous, bright, smooth deposit which is appealing from an appearance viewpoint. Functionally, deposits should be resistant to corrosion and should possess optimum strength, ductility, and other like properties. The best deposits are those which provide a combination of the desired decorative brightness and the desired functional properties.

In the formulation of electroplating baths, the industry has available to it a wide variety of chemicals from which to choose for providing deposits having the desired decorative and functional properties. These chemicals are generally provided singly, or in combination with one or more other chemicals also used in the electroplating bath, in either dry or liquid form, and are mixed with water and other ingredients in appropriate concentrations to form the final electroplating bath. Ideally, all the chemicals or mixtures employed are soluble in water at the concentrations and temperatures employed. In many cases, however, certain of the chemicals, such as those used as brighteners (or grain refining agents as they sometimes are referred to), are not wholly soluble or are completely insoluble in the aqueous plating bath. In these cases, resort has been made in the past to utilization in the bath of materials which assist in the dissolution or substantially uniform dispersion of these chemicals in the bath, such as surfactants, wetting agents or emulsifiers. However, because these chemicals typically are employed in very low concentrations relative to the total bath composition, complete and uniform dispersion of the chemical throughout the bath is essential to attainment of the functional effect sought to be achieved with the chemical. Such dispersion is difficult to attain through mere addition of the chemical per se to the bath. Thus, in some situations, the particular chemical additive preferably is first dissolved in a solvent therefor, or first mixed with an emulsifier or other dispersion-aiding material, prior to admixture of the additive with the remaining components of the plating bath. In these situations, manufacturers of particular additives find it useful to prepackage the additive in admixture with these solubilizing or dispersing materials.

Water-insoluble brighteners and other additives often are packaged in solution with organic solvents such as cellosolves or alcohols (e.g., methanol, isopropyl alcohol), the solutions containing up to about 30% by weight of the brightener. The brightener/solvent mixture is then added to the electroplating bath at levels appropriate to yield a desired concentration of brightener in the bath, typically in the range of about 0.0001 gm/l to about 10 gm/l, the brightener being dispersed in the bath upon addition through the presence in the bath, if required, of various surfactants or wetting agents. Use of brightener/organic solvent mixtures as additives in electroplating baths, however, presents numerous difficulties. For example, the organic solvents generally are highly flammable and care must be taken with respect to handling, shipping and storage of the additive solutions. In addition, the organic solvent may present toxicity problems with respect to its handling. Still further, the use of organic solvents, derived from petroleum feedstocks, raises the cost of the overall brightener additive substantially. Most importantly, use of the brightener additive necessarily results in the addition to the bath of the organic solvent. In order to insure that adverse effects on plating quality and processing conditions do not occur as a result of this addition of organic material, the solvent must be chosen with particular care, and typically only after extensive testing.

It would be particularly useful, therefore, if substantially water-insoluble additives for electroplating baths, such as brighteners, could be provided in prepackaged form along with materials which promote dissolution or dispersion of the additive in the bath, but wherein organic solvents are not required. To be useful as a prepackaged component for electroplating baths, the additive should be stable in the form in which it is packaged for extended periods of time and under a substantial range of conditions.

SUMMARY OF THE INVENTION

According to the present invention, and as described in detail hereinafter, it has been found that a microemulsion comprised of a brightener (or other substantially water-insoluble functional electroplating material), water and a surfactant component is ideally suited as an additive to electroplating baths. In particular, the microemulsion, containing at least about 1% of the brightener by weight (based on the total weight of the microemulsion), is stable over extended periods of time and, upon addition to the electroplating bath at appropriate levels of use, provides the brightener in the bath in a uniformly dispersed form suitable for immediate use without need of either particular processing steps (e.g. extensive mixing, agitation) or the further presence in the bath of added surfactants, wetting agents or emulsifiers. Importantly, organic solvents are not required for dissolution or dispersion of the water-insoluble brightener or other additive.

PRIOR ART

U.S. Pat. No. 4,263,106 to Kohl discloses the use in tin/lead electroplating baths of functional heterocyclic additives. To promote solubility of the additive, a small amount of solvent that dissolves the additive and dissolves in the aqueous electroplating bath is used. Typically, the additive is first dissolved in alcohol and then added to the bath as an alcohol solution.

U.S. Pat. Nos. 3,977,949; 4,061,547; and 4,072,582 to Rosenberg disclose acid tin electroplating baths containing brightening agents such as dialkoxy benzaldehydes and alkoxy naphthalene carboxaldehydes. Emulsifying agents of the anionic, cationic, nonionic or amphoteric type are added to the electroplating baths to aid in the dispersion of these brighteners. Alternatively, the emulsifiers can be mixed with the brighteners and the mixture then added to the bath.

U.S. Pat. No. 3,748,237 to Creutz et al and U.S. Pat. No. 4,119,502 to Arcilesi disclose electroplating baths for zinc electroplating which contain emulsifying agents or surfactants in the bath itself.

U.S. Pat. No. 3,839,166 to Michael discloses aqueous acid nickel electroplating baths containing a primary polishing agent and an adduct of ethylene oxide and/or propylene oxide emulsified in the bath electrolyte at specified temperatures. The adducts are designed to form fine emulsions, exhibited as turbidity, when added to the plating bath at the operating bath temperatures.

German Offenlegungsschrift 2,948,261 discloses the use of brightening agents in conjunction with nonionic surfactants for use in zinc electroplating.

DESCRIPTION OF THE INVENTION

In the description which follows, the functional additive for use in electroplating baths is taken to be a brightening agent which per se is substantially water-insoluble at the contemplated temperatures and concentrations in a particular working plating bath composition. In addition, the brightening agent is substantially water-insoluble at the conditions at which the microemulsion of the present invention is formed and the conditions to which the microemulsion may be subjected during shipping and storage. However, as will be apparent to those skilled in this art, the basic features of the invention described herein may also be applicable to other chemicals used as functional additives, for purposes other than brightening, in electroplating baths and processes.

The composition of the present invention is a stable microemulsion comprised of brightening agent, water and a surfactant component. The concentration of brightening agent in the composition, relative to the total weight of the composition of the microemulsion, is at least about 1% by weight, and preferably between about 3% and 30% by weight.

For use in the present invention, the brightening agent is any of the known, wholly or partially water-insoluble chemicals known for use as additives to plating baths to provide luster to the electroplated deposit. Examples of such agents are o-chlorobenzaldehyde, anisaldehyde, veratraldehyde, benzilidene acetone, trichlorobenzene, ortho-toluidine, naphthyl methyl ketone, heliotropine, vanillin, hydroquinone, coumarin and orthochloroaniline. The brightening agent is liquid at the temperatures employed in formation of the microemulsion.

Significantly, it has been found that the entire microemulsion itself can be frozen and thawed for use without destruction of the microemulsion provided suitable surfactants and/or stabilizers are employed. As a consequence, the microemulsion can be subjected to a wide variety of storage and shipping conditions without loss of stability or functionality.

Microemulsions are systems containing two liquid phases, water (w) and oil (o), one of which is dispersed in globules in the other, wherein the droplet diameters are in the range of 80 Å to 2000 Å. In the context of the present invention, the "oil" phase is the liquid, substantially water-insoluble brightener. The system can be an oil-in-water (o/w) microemulsion, wherein oil droplets are dispersed in the water phase, or a water-in-oil (w/o) microemulsion, wherein water droplets are dispersed in an oil phase. Microemulsions are characterized by translucency and exceptional stability, as well as by their relative ease of formation (given the proper components, levels of use and temperatures) without need for excessive working, homogenization or agitation.

Additional discussion of the nature of microemulsions in general, their chemical and physical properties and their methods of preparation can be found, for example, in L. M. Prince, *Microemulsions* (Academic Press 1977).

In forming the microemulsion of the present invention, the essential components are the brightening agent, water and a surfactant component.

The surfactant component may comprise one or more hydrophilic or lipophilic materials suitable for forming microemulsions involving a water phase and an oil phase (consisting of the liquid brightening agent). As used in the context of the present invention, the term "surfactant" is intended to include materials sometimes referred to in more detailed classifications as emulsifiers or wetting agents or surface active agents. The function of the surfactant is to alter the surface tension of the phases, rendering these normally substantially mutually insoluble phases capable of forming stable microemulsions containing droplets of one phase in the other.

The surfactant component also must possess the property of not interfering with or adversely affecting the plating properties (e.g., the throwing power) of the electroplating bath to which it is added as part of the brightening agent-containing microemulsion. In addition, the surfactant component must be such as to not adversely affect the chemical and physical properties of the electroplating bath. In particular, the surfactant component chosen should be one which, at the concentrations employed, will not, upon its addition to the bath as a microemulsion, cause the bath or any components thereof to decompose or "oil out" by virtue of the cloud point of the bath being lowered by such addition to a temperature below that at which the electroplating process optionally is conducted. Still further, the surfactant component will be chosen such that stability of the microemulsion is achieved over a wide range of temperatures.

Choice of a particular surfactant component will involve an appropriate balancing of surfactant type and amount to achieve microemulsion formation, microemulsion stability and non-interference with the electroplating bath and process for a given brightening agent, a given electroplating bath and a given set of electroplating conditions.

While the surfactant component may consist of a single surfactant, it is preferable that a combination of surfactants (sometimes referred to as surfactant and co-surfactant) be employed so as to more readily yield the desired stable microemulsions. Preferably, the surfactant will comprise a combination of hydrophilic surfactants, lipophilic surfactants, or hydrophilic and lipophilic surfactants. The levels of use of the overall surfactant component typically will be above about 10% by weight of the oil component of the microemulsion, and preferably from about 15% to about 200%. The relative ratios of surfactant and co-surfactant will vary depending on such factors as the particular materials employed, the overall level of use and the type and concentration of brightener in the microemulsion. Lipophilic surfactants generally have an HLB (hydrophile-lipophile balance) of less than about 7, typically from about 4 to 7, and hydrophilic surfactants generally have an HLB of from about 8 to 20, typically from about 9 to 20.

Extensive generalized discussion of the various methods for forming microemulsions and suitable surfactants therefor is provided in the *Microemulsions* text earlier referred to. For use in the present invention, preferred surfactant components have been found to be long chain ethoxylated phenols, such as those available from GAF Corp. under the trade name Igepal (a family of long chain ethoxylated phenols characterized by varying moles of ethylene oxide employed in their preparation and the size of the ring adduct). Preferably these surfactants are used in combination with various other surfactants such as dioctyl sodium sulfosuccinate, sulfonates and polyethylene glycols.

In forming the microemulsions of the present invention, particular components and their levels of use are chosen simply to arrive at the required microemulsive system, characterized by translucency, stability and the diameter of the droplets of the dispersed phase. However, it is essential that the brightening agent in the microemulsion comprise at least about 1% by weight, based on the total weight of the microemulsion components, and preferably between about 3% to about 30% by weight. At concentration of brightener in the microemulsion of below 1%, addition of the brightening agent (in the form of a microemulsion) to the electroplating bath at levels sufficient to provide the appropriate concentration of brightening agent in the bath can have the effect of providing quantities of surfactants and water to the bath which may be so high as to adversely affect the electroplating properties of the bath. In addition, compositions containing only small concentrations of brightening agent may be difficult to form into microemulsions. Further, dilute brightening agent compositions involve more costly packaging and shipping per unit of functionality.

A distinct advantage of the microemulsion composition of the present invention is the ability to provide brightening agent in the form of a stable concentrate which, when added to an electroplating bath, results in uniform dispersion of the agent in the bath without the need for excessive working of the bath, agitation or the like, which often leads to undesirable foaming of the bath. It is not presently known whether the microemulsion of the present invention remains as such upon its addition to the electroplating bath. However, regardless of the particular state of the emulsion in the bath, the microemulsion apparently itself provides sufficient surfactant additive to the bath to ensure uniform dispersion of the brightening agent. For particular cases, of course, it may be found desirable to include surfactant materials in the bath other than those provided by the microemulsion to assist in the dissolution or dispersion of ingredients other than the functional material added by way of the microemulsion.

According to the present invention, the term "stable", as applied to the microemulsion, defines compositions which, at the temperatures of formation and storage will not exhibit any significant degree of phase separation or weeping for periods of at least about six months. Where desired, this stability can include the ability of the microemulsion to survive one or more freezing/thawing cycles by utilizing appropriate surfactants and stabilizer materials.

Another advantage of the present invention is the capability of eliminating the use of organic solvents in the pre-packaged brightener additive. Small quantities of organic solvent can, if desired, be included in the microemulsion as a means of further aiding dissolution or dispersion, but typically the levels of usage will be less than about 10% by weight of the weight of the components of the microemulsion, and preferably less than about 5% by weight.

The additive composition of the present invention can be employed in any number of electroplating baths. Particularly good results have been achieved in acid zinc and acid cadmium baths, but the invention is not limited to specific bath compositions. For each particular electroplating bath, the type and concentration of brightening agent, or other functional additive, and the type and quantity of surfactants employed, are chosen so as to be compatible with other components of the bath and the conditions of use.

The invention is further illustrated with reference to the following examples.

EXAMPLE I 1500 grams of o-chlorobenzaldehyde and 1650 grams of Igepal CA-720 (octyl phenol ethoxylate 12, manufactured by GAF Corp.) were weighed together and poured into a 22 liter round bottomed flask with gentle agitation. Water (22°-25° C.) was weighed into 5 equal portions of 3369 grams each. The first portion of 3369 grams of water was added to the flask at a rate of about 1 liter per minute accompanied by agitation. After about 4 liters had been added, the contents of the flask were white in color becoming thick and viscous. During addition of the second 3369 gram portion of water at the same rate, the viscosity began to drop and the agitation rate was decreased. The remaining three portions of water were added at slightly faster rates. After mixing for 20 minutes, 400 grams of Aerosol OT-75 (dioctyl sodium sulfosuccinate, manufactured by American Cyanamid Corp.) was added to the flask and mixed for 30 minutes. The final product was clear with a slight blue haze. The product was packaged in one gallon glass containers. The product was found to be stable on standing with no separation of components.

EXAMPLE II

The brightener additive of Example I was used as a brightener additive in a commercially available acid zinc electroplating bath known as Kenlevel II manufactured by Minnesota Mining and Manufacturing Company. This bath contains water, zinc chloride (4 oz./gal.), potassium chloride (18 oz./gal.), boric acid (4 oz./gal.) with 1% by volume nonyl-phenol-ethylene oxide surfactant with benzoic acid added. The brightening additive of Example I was used in place of a conventional additive, which contains cellosolve and o-chlorobenzaldehyde. The additive dispersed readily in the bath (pH 5.0; temperatures 85° F.) and provided good brightening results (level of brightener = 75 mg/l, maintained by periodic addition of brightening additive). Brightener usage averaged 3.7 fluid ounces per 1000 ampere hours for the brightener of this invention as compared to 4 fluid ounces per 1000 ampere hours standard usage for the prior art additive.

EXAMPLE III

A microemulsion brightener additive was prepared containing 14.5% by weight Igepal CO-730 (ethoxylated nonyl-phenol), 6.8% by weight o-chlorobenzaldehyde, 1.6% by weight isopropyl alcohol, 3.6% by weight Aerosol OT-75 and 73.5% by weight deionized water. The Igepal CO-730 and o-chlorobenzaldehyde were mixed in a stainless steel container. The mixture was heated while stirring until a temperature of 100°-110° F. was reached and the solution turned clear. The isopropyl alcohol was added and the mixture stirred. About ⅔ of the water was added, followed by addition of ammonium xylene sulfonate (3.6% by weight based on total composition) as a stabilizer, stirring throughout the additions. The rest of the water was added and stirred until clear. The product was packaged and found to be clear and stable with no separation of components 2 months after packaging. The product was not flammable and found to have a freeze point of 32° F. The product was bottled and frozen overnight in a commercial freezer, then thawed at room temperature. No decomposition or separation of components was found.

EXAMPLE IV 50 grams of trichlorobenzene was mixed with 56 grams of Igepal CA-720 at a temperature of 110°–120° F. until a clear mixture was formed. About 300 grams of water was added while mixing followed by 12 grams of Aerosol OT-75. The rest of the water was added with stirring. The final mixture was clear and stable with no separation. The mixture was packaged and remained stable upon standing at room temperature. The mixture was observed after a month and found to be clear and stable.

EXAMPLE V 50 grams of trichlorobenzene was mixed with 110 grams of Igepal CO-730 at 110°–120° F. until clear. 12 grams of isopropyl alcohol was added and mixed to give a clear solution. 300 grams of water was added and stirred. 26 grams of ammonium xylene sulfonate and 26 grams of Aerosol OT-75 was added and stirred. 210 grams of water was added. The final mixture was clear with no separation and remained so when observed after a month of standing at room temperature as in Example III.

EXAMPLE VI

A microemulsion was formed with 50 grams anisaldehyde, 110 grams Igepal CO-730, 12 grams isopropyl alcohol, 26 grams ammonium xylene sulfonate, 26 grams aerosol OT-75 and 510 grams water according to the method of Example III. The resultant mixture was clear and showed no sign of separation of components. Stability was observed after a month as in Example III.

EXAMPLE VII

A microemulsion was formed with 75 grams of Igepal CO-730, 15 grams of veratraldehyde, and 22 grams of acrylamide. The veratraldehyde and acrylamide were mixed and added to the Igepal which had been heated in water to a temperature of 60°–70° C. The mixture was stirred while water was added slowly to a total volume of 500 ml. The final product was clear and stable with no separation of components observed.

EXAMPLE VIII

A test of the effect of the surfactant combination employed in Example I on the throwing power and current efficiency of an electroplating bath and process was conducted. The electroplating bath was Kenlevel II, an acid zinc electroplating bath having the composition described in Example II. Orthochlorobenzaldehyde in cellosolve was employed as the brightener in the bath (1.25% by volume) and levels of combined surfactant (at a constant ratio per Example I) were varied as shown in Table I.

In the testing procedure, two Harving cells were wired in series, one cell containing the test solution and one cell containing lead fluoborate (control—100% efficiency), and each test run for 20 minutes at constant 1.3 amps (15 ASF). Test panels were cleaned, dried and weighed on an analytical balance before and after plating. The pH of the test solution was 5.0 and the temperature of the bath 85° F.

The results of the tests are shown in Table I below.

TABLE I

| Surfactant Amount (% by vol.) | Efficiency (%) | Throwing Power (%) | Control Cell Efficiency (%) |
|---|---|---|---|
| — | 100.8 | 30.2 | 100.12 |
| 0.75 | 100.98 | 30.4 | 100.42 |
| 0.75 | 101.21 | 30.38 | 100.36 |
| 1.5 | 98.74 | 25.08 | 100.26 |
| 3.0 | 100.92 | 29.72 | 100.22 |
| 6.0 | 101.05 | 32.28 | 100.08 |
| 12.0 | 98.4 | 33.65 | 99.25 |
| 24 | 98.8 | 34.86 | 100.15 |
| 48 | 101.0 | 38.61 | 100.70 |
| 48 | 100.11 | 37.31 | 99.90 |

What is claimed is:

1. A composition for use as an additive to electroplating baths, comprising a stable microemulsion consisting essentially of water, a functional electroplating agent and a surfactant component, the concentration of said electroplating agent in said microemulsion being at least about 1% by weight based on the total weight of components of the microemulsion, said functional chemical electroplating agent being one which is substantially water-insoluble at the concentrations and conditions prevailing in said microemulsion and at the concentrations and conditions existing in said electroplating bath.

2. The composition according to claim 1 wherein said functional chemical electroplating agent is a brightening agent.

3. The composition according to claim 2 wherein said surfactant component comprises a combination of at least two surfactants.

4. The composition according to claim 2 wherein said surfactant component comprises a combination of a long chain ethoxylated phenol and at least one additional surfactant.

5. The composition according to claim 4 wherein said additional surfactant is dioctyl sodium sulfosuccinate.

6. The composition according to claim 2 wherein said surfactant component comprises a combination of members selected from hydrophilic surfactants, hydrophobic surfactants and mixtures thereof.

7. The composition according to claim 2 wherein said brightening agent is present in said microemulsion at a concentration of about 3% to about 30% by weight, based on the total weight of components of the microemulsion.

8. The composition according to claim 2 wherein said brightening agent is selected from the group consisting of o-chlorobenzaldehyde, anisaldehyde, veratraldehyde, benzilidene acetone, trichlorobenzene, orthotoluidine, naphthyl methyl ketone, heliotropine, vanillin, hydroquinone, coumarin and o-chloroaniline.

9. A composition for use as a brightening additive to metal electroplating baths, comprising a stable microemulsion consisting essentially of water, a brightening agent, a long chain ethoxylated phenol and dioctyl sodium sulfosuccinate, the concentration of said brightening agent in said microemulsion being from about 3% to about 30% by weight, based on the total weight of components of the microemulsion, said brightening agent being one which is substantially water-insoluble at the concentrations and conditions prevailing in said microemulsion and at the concentrations and conditions prevailing in said electroplating bath.

10. A composition for use as an additive to electroplating baths, comprising a stable microemulsion consisting essentially of water, a brightening agent selected from the group consisting of o-chlorobenzaldehyde, anisaldehyde, veratraldehyde, benzilidene acetone, trichlorobenzene, orthotoluidine, naphthyl methyl ketone, heliotropine, vanillin, hydroquinone, coumarin and o-chloroaniline and a surfactant component, comprising a combination of at least one hydrophilic surfactant and at least one lipophilic surfactant, the concentration of said electroplating agent in said microemulsion being at least about 1% by weight based on the total weight of components of the microemulsion.

11. The composition according to claim 10 wherein said surfactant component comprises a long chain ethoxylated phenol and dioctyl sodium sulfosuccinate.

12. A composition for use as an additive to electroplating baths, comprising a stable microemulsion consisting essentially of water, a brightening agent, a surfactant component and an additional material selected from the group consisting of aromatic sulfonates and heterocyclic sulfonates, the concentration of brightening agent in said microemulsion being at least about 1% by weight based on the total weight of the components of the microemulsion, said brightening agent being one which is substantially water-insoluble at the concentrations and conditions prevailing in said microemulsion and at the concentrations and conditions existing in said electroplating bath.

13. The composition according to claim 12 wherein said surfactant component comprises an ethoxylated nonylphenol and dioctyl sodium sulfosuccinate.

14. The composition according to claim 13 wherein said additional material is ammonium xylene sulfonate.

15. The composition according to claim 14 further comprising an organic solvent for said brightening agent, said solvent being present in said microemulsion at a concentration of less than about 5% by weight of the total weight of the components of the microemulsion.

16. A composition for use as an additive to electroplating baths, comprising a stable microemulsion comprised of water, a functional electroplating agent and a surfactant component, the concentration of said electroplating agent in said microemulsion being at least about 1% by weight based on the total weight of components of the microemulsion, said functional chemical electroplating agent being one which is substantially water-insoluble at the concentrations and conditions prevailing in said microemulsion and at the concentrations and conditions existing in said electroplating bath, said microemulsion containing less than 10% by weight of a polar organic solvent for said functional electroplating agent.

17. A composition for use as a brightening additive to metal electroplating baths, comprising a stable microemulsion comprised of water, a brightening agent, a long chain ethoxylated phenol and dioctyl sodium sulfosuccinate, the concentration of said brightening agent in said microemulsion being from about 3% to about 30% by weight, based on the total weight of components of the microemulsion, said brightening agent being one which is substantially water-insoluble at the concentrations and conditions prevailing in said microemulsion and at the concentrations and conditions prevailing in said electroplating bath, said microemulsion containing less than 10% by weight of a polar organic solvent for said brightening agent.

18. A composition for use as an additive to electroplating baths, comprising a stable microemulsion comprised of water, a brightening agent, a surfactant component and an additional material selected from the group consisting of aromatic sulfonates and heterocyclic sulfonates, the concentration of brightening agent in said microemulsion being at least about 1% by weight based on the total weight of the components of the microemulsion, said brightening agent being one which is substantially water-insoluble at the concentrations and conditions prevailing in said microemulsion and at the concentrations and conditions existing in said electroplating bath, said microemulsion containing less than 10% by weight of a polar organic solvent for said brightening agent.

19. A composition for use as an additive to an electroplating bath, comprising a stable microemulsion comprised of water, a functional electroplating agent and a surfactant component, the concentration of said electroplating agent in said microemulsion being at least about 1% by weight based on the total weight of components of the microemulsion, said functional electroplating agent being one which is substantially water-insoluble at the concentrations and conditions prevailing in said microemulsion and at the concentrations and conditions existing in said electroplating bath, said microemulsion containing less than 5% by weight of a polar organic solvent for said functional electroplating agent.

20. A composition for use as an additive to an electroplating bath, comprising a stable microemulsion comprised of water, a functional electroplating agent and a surfactant component, the concentration of said electroplating agent in said microemulsion being at least about 1% by weight, based on the total weight of components of the microemulsion, said functional electroplating agent being selected from the group consisting of o-chlorobenzaldehyde, veratraldehyde, benzilidene acetone, trichlorobenzene, orthotoluidine, naphthyl methyl ketone, heliotropine, vanillin and coumarin.

21. A composition for use as a brightening additive to metal electroplating baths, comprising a stable microemulsion of water, o-chlorobenzaldehyde, a long chain ethoxylated phenol and dioctyl sodium sulfosuccinate, the concentration of said o-chlorobenzaldehyde in said microemulsion being from about 3% to about 30% by weight, based on the total weight of components of the microemulsion.

* * * * *